United States Patent [19]

Japhet

[11] Patent Number: 4,502,316

[45] Date of Patent: Mar. 5, 1985

[54] HYDRAULIC CYLINDER RECONDITIONER

[76] Inventor: William D. Japhet, 430 Summit Lake Shore Rd. Northwest, Olympia, Wash. 98502

[21] Appl. No.: 526,790

[22] Filed: Aug. 26, 1983

Related U.S. Application Data

[63] Continuation of Ser. No. 285,807, Jul. 22, 1981, abandoned.

[51] Int. Cl.[3] ..... B21D 3/14

[52] U.S. Cl. ..... 72/392

[58] Field of Search ..... 72/370, 392, 393

[56] References Cited

U.S. PATENT DOCUMENTS

| | | | |
|---|---|---|---|
| 1,157,073 | 10/1915 | Baash | 72/392 |
| 1,623,405 | 4/1927 | Gocke et al. | 72/392 |
| 1,623,657 | 4/1927 | Brown | 72/392 |
| 1,837,690 | 12/1931 | Sunde | 72/392 |
| 2,799,318 | 7/1957 | Blucher et al. | 72/56 |
| 2,900,853 | 8/1959 | Steck | 72/705 |
| 3,292,903 | 12/1966 | Meyer et al. | 72/392 |
| 4,270,379 | 6/1981 | Van Gompel | 72/392 |

FOREIGN PATENT DOCUMENTS

| | | | |
|---|---|---|---|
| 2411842 | 9/1974 | Fed. Rep. of Germany | 72/392 |

*Primary Examiner*—Lowell A. Larson

*Attorney, Agent, or Firm*—Seed and Berry

[57] ABSTRACT

A hydraulic cylinder reconditioner has a base to dispel radial forces not directly under a dent and a piston on the base to bear radially outwardly under a dent to remove the dent without substantially distorting the original dimensions of the remainder of the cylinder. A method of using this reconditioner allows hydraulic cylinders to be quickly reconditioned rather than to be discarded when dented.

9 Claims, 3 Drawing Figures

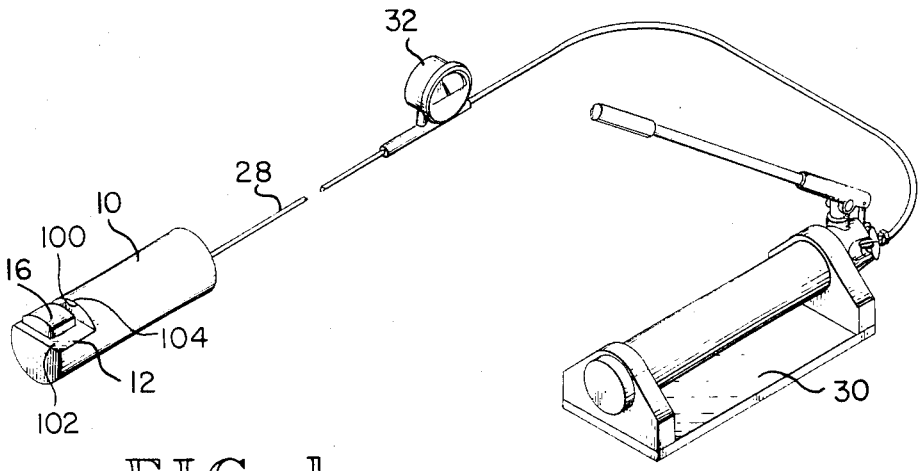
FIG. 1
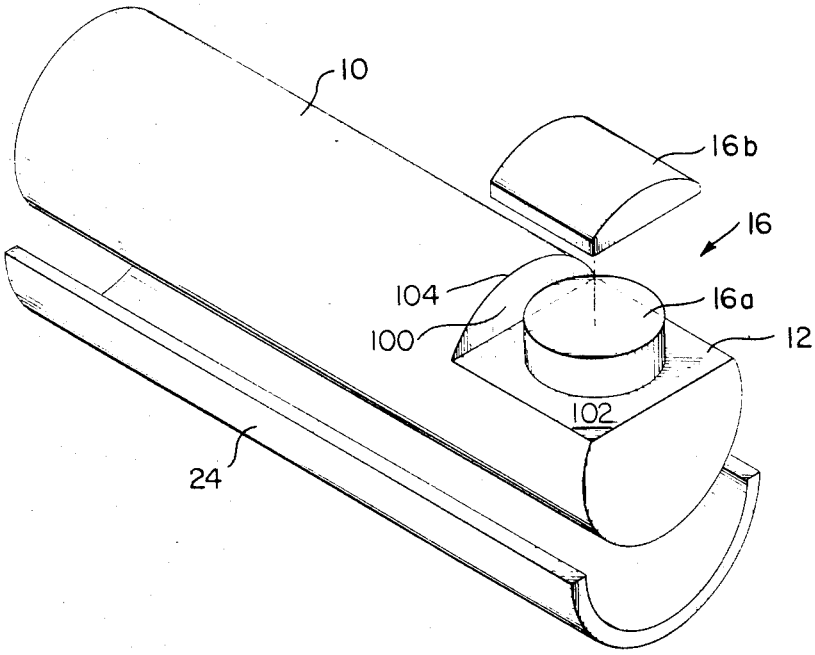
FIG. 2
FIG. 3
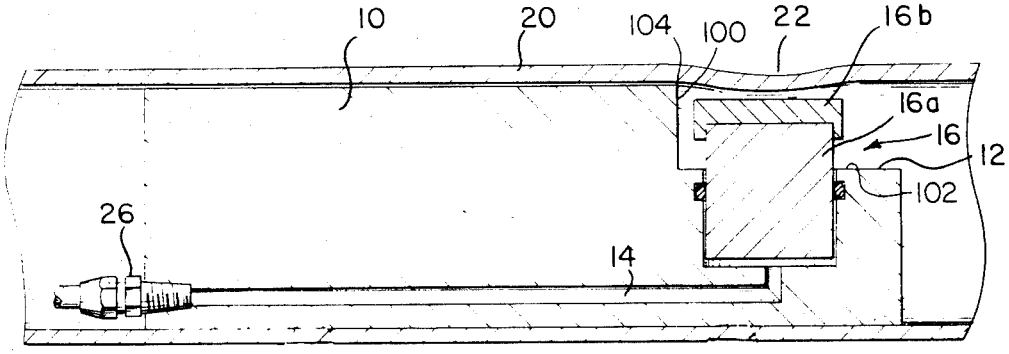

HYDRAULIC CYLINDER RECONDITIONER

This application is a continuation of U.S. patent application Ser. No. 285,807, filed July 22, 1981 now abandoned.

DESCRIPTION

1. Technical Field

The present invention relates to an apparatus for removing dents from hydraulic cylinders. More particularly, the invention relates to a novel apparatus which removes dents selectively from a portion of the hydraulic cylinder without distorting the dimensions of the remainder of the cylinder. This apparatus restores the hydraulic cylinder to its originally fabricated dimensions, allowing reuse of the cylinder rather than replacement.

2. Background Art

Characteristically, when hydraulic cylinders become dented today, the cylinders are removed and are entirely replaced with new cylinders. A new cylinder costs approximately $250–$300, and available means to recondition the cylinder cost substantially this amount. Therefore, it is easier to replace the cylinder entirely rather than to recondition the cylinder.

Known reconditioners further have the problem of being able to reach only a small portion of the total length of a hydraulic cylinder. For example, one method known to the applicant is able to each only the first 8–10 inches (20–25 cm) of the cylinder. Therefore, the apparatus has very limited application and potential.

Many devices are known for expanding the diameter of a piece of tubing. These devices sacrifice simplicity in mechanism because they must supply a substantial force to the entire circumference of the inside diameter of the tubing to be expanded. Because these devices are designed to expand the entire dimensions of the pipe, if they were used to remove a dent from a small portion of the inside diameter of a hydraulic cylinder, the devices would tend to distort the other dimensions of the pipe around the dented area. Thus, the devices would be impractical, undesirable, or inoperable. Although the dent might be removed, the cylinder still would not be reusable. Representative of tube-expanding devices are those devices shown in the following United States patents:

| Inventor | U.S. Pat. No. |
|---|---|
| Anderson | 4,006,619 |
| Morrill | 2,461,565 |
| Primrose | 1,494,128 |
| Hilton | 3,260,097 |
| Seeloff | 3,102,502 |
| Travis | 1,680,650 |
| Jones | 3,710,609 |
| Sherman | 1,550,285. |

Similar in concept to the pipe tubing expander devices is a pipe maintenance apparatus disclosed in U.S. Pat. No. 4,004,444. Two hemispherical segments are toggled radially outwardly to contact the inside diameter of a large pipe, such as an oil well drilling pipe, to remove dents and other anomalies in the wall of the pipe. This pipe maintenance apparatus is very large and complex, featuring means for holding the large and heavy pipe as well as means for positioning the hemispherical segments relative to the held pipe. Not only would this mechanical complexity make the use of the pipe maintenance apparatus of U.S. Pat. No. 4,004,444 impractical and uneconomical for reconditioning hydraulic cylinders, but the segments, which bear radially outwardly against substantially the entire inside diameter of the pipe to be reconditioned, would potentially distort the dimension of the pipe in other areas than that of the dent. Because it is critical that a hydraulic cylinder be true (so that the cylinders function smoothly), it is important that a reconditioning device only remove the dented portion from the cylinder without substantially distorting the original dimensions of the hydraulic cylinder. Bearing outwardly with equal pressure in all radial directions is unlikely to achieve the desired effect of removing the dent in the hydraulic cylinder without substantially distorting the original dimensions of the cylinder.

To remove dents from thin-walled pipe or automobile panels, devices apply relatively weak forces to the ductile metals used. See, e.g., U.S. Pat. Nos. 2,341,278 and 2,780,122.

U.S. Pat. No. 3,817,079 discloses a spreading tool for restoring the shape of annular products. A hydraulic expansible wedge is positioned below a dent by pounding the wedge tip into the center of the collapsed core. Useful for rolls of paper, plastic film, tubing and metal foil, this tool would be difficult to position beneath a dent and would probably cause scoring of the cylinder when pounded into position. Because the core of rolled items is unimportant, this tool ignores the irreversible harm done to the core in some circumstances.

U.S. Pat. No. 2,916,076 discloses an apparatus for fabricating arch-type culverts which extend segments to bend a generally circular pipe into an elliptical or oblong shape.

DISCLOSURE OF INVENTION

The present invention relates to an inexpensive, quick, lightweight, portable, hand-operable hydraulic cylinder reconditioner which removes dents from along substantially any portion of the wall of the hydraulic cylinder. Broadly described, the hydraulic cylinder reconditioner of this invention has a generally cylindrical base having a cutout and an internal channel extending from one end of the base to the cutout. A piston is sealingly slidable in the cutout to extend radially under pressure supplied below the piston through the channel to rise into contact with the inside diameter of the hydraulic cylinder below a dent. Pressure is supplied to provide sufficient force for the piston that the piston moves upwardly to remove the dent. The base is sized so that the imposition of pressure is dispelled over a sufficient surface area removed from the dent so that the original dimensions of the remainder of the cylinder remain substantially undistorted. When the dent is removed, the hydraulic cylinder is substantially restored to its original condition.

Preferably, the hydraulic cylinder reconditioner of this invention is lightweight, portable, and hand-operable so that it easily used either at the site where the hydraulic cylinder is dented or in the commonly owned shop. For example, the base of the reconditioner may be a six-inch long, solid piece of aircraft aluminum having an outside radial dimension substantially equal to (although somewhat slightly less than) the inside radius of the hydraulic cylinder to be reconditioned. Providing pressure through suitable means, a hand-operated hydraulic pump may be used to raise the piston so that dents may be removed. Within about ten minutes after disassembly of the hydraulic cylinder from its machinery, the hydraulic cylinder reconditioner of this invention can be inserted into the cylinder and positioned below the dent, pumped up to remove the dent, and extracted from the cylinder, leaving the cylinder in substantially its original condition. No longer need a contractor either maintain a large inventory of replacement cylinders or suffer long shutdown times in the replacement of hydraulic cylinders. Therefore, the hydraulic cylinder reconditioner of this invention not only reduces the actual material costs of hydraulic cylinders, but greatly reduces the total working costs of an operator.

To accommodate various sizes of hydraulic cylinders, the hydraulic cylinder reconditioner of this invention preferably includes a plurality of various sized cuffs which cradle about the base of the reconditioner to increase the effective diameter of the base so that the effective diameter is nearly as large as the inside diameter of the cylinder to be repaired. Similarly, the piston preferably has a replaceable cap which has various sized radial faces so that the face will conform substantially to the inside diameter of the cylinder to be repaired.

To recondition a dented hydraulic cylinder, the reconditioner of this invention is inserted into the cylinder so that its piston is positioned substantially directly below the dent. The piston is raised by suitable means to bear radially outwardly against the dent and to push the dent outward. The cylinder is tapped in the area around the dent to help the metal relax. The reconditioner is extracted, leaving a hydraulic cylinder which is substantially in its original condition. To ensure that the inside diameter is smooth, a hone may be used to run adjacent the area of the dent along the inside of the cylinder. Heating the area of the dent reduces the force required to remove the dent.

BRIEF DESCRIPTION OF THE DRAWINGS

FIG. 1 is a perspective view of a preferred hydraulic cylinder reconditioner.

FIG. 2 is an isometric view of the reconditioner of FIG. 1.

FIG. 3 is a sectional detail of the hydraulic cylinder reconditioner of FIG. 2 in position to remove a dent.

BEST MODE FOR CARRYING OUT THE INVENTION

The hydraulic cylinder reconditioner of the present invention greatly reduces the costs involved in repairing dented hydraulic cylinders by allowing the quick and accurate repair of dents either at the site or in a local garage. No longer need the dented hydraulic cylinder be discarded and replaced with new cylinders. Any dent found along substantially any portion of the cylinder may be readily removed with a reconditioner of the present invention.

As shown in the figures, the hydraulic cylinder reconditioner of the present invention has a generally cylindrical base 10 fabricated, for example, from aircraft aluminum or other suitable metal. The base 10 has a cutout 12 near one end and an internal channel 14 connecting one end of the base 10 with the cutout 12. The channel 14 is used to supply a pressure to the cutout 12. A piston 16 is sealingly positioned with suitable means 18, such as a Parker "T" TP-24 O-ring seal, to be radially extensible under a pressure supplied below the piston 16 in the cutout 12.

As shown in the drawings, especially FIG. 3, the cutout 12 is defined by a radial wall 100 a predetermined distance from an end of the reconditioner and an axial wall 102. The piston 16 fits within an opening in the axial wall 102. The radial wall 100 defines a shoulder 104 at the intersection of the wall 102 and the cylindrical periphery of the base 10. As shown in FIG. 3, the piston, comprising a stem **16*a* and cap 16*b*, is retractable below the shoulder 104. The shoulder 104 allows accurate positioning of the piston below the dent by limiting the penetration of the reconditioner into the dented hydraulic cylinder, as shown in FIG. 3**.

The piston 16 preferably has two portions. A stem **16*a* is sized to fit in the cutout 12, and a cap 16*b* is operatively associated with the stem 16*a* and has an outer radial face which contacts the cylinder 20 and which substantially conforms with the configuration of the original inside diameter of the cylinder 20. Therefore, when positioned substantially directly below a dent 22 in the hydraulic cylinder 20, and when raised by sufficient pressure, the piston 16 will bear against the dented area and will push the dent 22 radially outwardly to restore the hydraulic cylinder to its original undistorted dimensions. While the piston 16 bears radially outwardly, the dimensions of the base 10 are such that the forces against the hydraulic cylinder in directions other than the area around the dent 22 are substantially dispelled so that the original dimensions of the hydraulic cylinder are substantially undistorted, although the dent is substantially removed. To accomplish this dispelling of forces in radial directions other than directly below the dent, the hydraulic cylinder reconditioner base 10** of this invention is generally about six inches (15 cm) long for hydraulic cylinder customarily found on heavy equipment.

To make the hydraulic cylinder reconditioner of this invention adaptable to various sizes of hydraulic cylinders, a plurality of various sized cuffs 24 are available to cradle the base 10 and to increase thereby the effective diameter of the base 10 so that the effective diameter of the tool is nearly as large as the inside diameter of the hydraulic cylinder to be repaired. As best shown in FIG. 2, the cuff 24 is a hemispherical or other suitable circle segment whose inside diameter substantially conforms to the outside diameter of the base 10 and whose outside diameter is sized to conform substantially to the inside diameter of the hydraulic cylinder to be repaired. In some applications, it may be desirable to use a plurality of cuffs to increase the diameter of the base 10 gradually rather than to use one cuff 24 to increase the diameter in one step. In other words, to increase the diameter of the base 10 from $3\frac{1}{2}$ inches to $4\frac{1}{2}$ inches, it may be desirable to use two cuffs. The first cuff would increase the diameter from $3\frac{1}{2}$ inches to about 4 inches, and the second cuff would increase the outside diameter from 4 inches to $4\frac{1}{2}$ inches.

Through a pressure fitting 26, the base 10 is connected to a pressure tubing 28 which extends to a hand-operable, hydraulic pump 30 which is adequate to supply sufficient pressure below the piston 16 to remove dents in the hydraulic cylinder to be repaired. Ordinarily, a 10,000 pound hand pump will be adequate to recondition hydraulic cylinder tubes. To monitor the pressure supplied by the pump 30, a gauge 32 may be placed in the line between the pump 30 and the base 10.

Because the piston 16 (or, more preferably, the cap **16*b*) bears against the inside diameter of the hydraulic cylinder 20, the piston 16** should be constructed of a relatively hard steel. Chrome shafting is operable, although a harder metal, such as heat-treated, stress-proof steel, a stainless steel, or titanium, may be preferred in continued operation. Further testing is required to specify the most desired material for the piston, because there is a delicate economical balance based upon the expected useful life of the piston and the cost of the various alternatives.

When removing a dent from a hydraulic cylinder, the base is inserted into the hydraulic cylinder to position the piston substantially directly below the dent in the cylinder. Adequate pressure is supplied with the hand pump to raise the piston into contact with the inside of the hydraulic cylinder and to push the dent radially outward. To help the metal to relax, gentle tapping is made around the dent from the outside of the cylinder while the pressure is maintained on the piston. Thereafter, the pressure from the pump is released and the base is extracted from the cylinder. Ordinarily, the reconditioned hydraulic cylinder will be adequate for reuse without further reconditioning. To ensure that the inside diameter of the cylinder is true, however, the inside surface may be honed. The pressure necessary to remove the dent may be decreased by heating the hydraulic cylinder in the area surrounding the dent.

I claim:

1. A hydraulic cylinder reconditioner to remove dents selectively from portions of a hydraulic cylinder without distorting the undented portion of the cylinder, leaving the cylinder in condition for reuse, comprising:

(a) a generally cylindrical base having a body and a cutout at one end of the body defining an axially extending wall and a radially extending wall forming a raised shoulder with the base for properly positioning the base below a dent; and (b) a piston in the axially extending wall of the cutout, retractable below the shoulder, being radially extensible by pressure supplied below the piston through an internal channel extending from one end of the base to the cutout (1) to raise the piston into contact with the inside diameter of the hydraulic cylinder below the dent with sufficient force to remove the dent while not distorting the dimensions of the remainder of the cylinder and (2) to restore the cylinder to within a close tolerance of its original undented shape so that the cylinder can be reused.

2. The reconditioner of claim 1, further comprising means for supplying pressure below the piston.

3. The reconditioner of claim 2 wherein the means for supplying pressure includes a pump for hydraulic fluid positionable outside the cylinder and a flexible pressure line connecting the pump to the channel to supply the hydraulic fluid below the piston.

4. The reconditioner of claim 3 wherein the body of the base has a generally smooth outer surface shaped to substantially match the inside diameter of the cylinder over greater than one-half the inside perimeter of the cylinder.

5. The reconditioner of claim 4 wherein the body includes a core and an adaptor cuff, and wherein the cuff has the outer surface that substantially matches the inside diameter of the cylinder.

6. The reconditioner of claim 4 wherein the piston includes a stem in a bore of the cutout and a cap which is connected to the stem and which is shaped to substantially conform to the undented inside diameter of the cylinder to be reconditioned.

7. The reconditioner of claim 6 wherein the cap is made from a metal selected from the group consisting of chrome shafting; heat-treated, stress-proof steel; and titanium.

8. The reconditioner of claim 3 wherein the pump is a hand-operable pump capable of supplying adequate pressure to recondition a hydraulic cylinder.

9. The reconditioner of claim 8, further comprising means for monitoring the pressure generated by the pump, viewable outside the cylinder when removing the dent, and wherein the line is long enough so that the pump can be operated from the vicinity of the dent outside the cylinder when removing the dent.

* * * * *